US010914325B2

(12) United States Patent
Biwersi

(10) Patent No.: US 10,914,325 B2
(45) Date of Patent: Feb. 9, 2021

(54) VALVE APPARATUS FOR INFLUENCING A FLOW OF MEDIUM

(71) Applicant: HYDAC SYSTEMS & SERVICES GMBH, Sulzbach (DE)

(72) Inventor: Sascha Alexander Biwersi, Mettlach (DE)

(73) Assignee: HYDAC SYSTEMS & SERVICES GMBH, Sulzbach/Saar (DE)

( * ) Notice: Subject to any disclaimer, the term of this patent is extended or adjusted under 35 U.S.C. 154(b) by 118 days.

(21) Appl. No.: 16/309,559

(22) PCT Filed: Jun. 16, 2017

(86) PCT No.: PCT/EP2017/000700
§ 371 (c)(1),
(2) Date: Dec. 13, 2018

(87) PCT Pub. No.: WO2017/220193
PCT Pub. Date: Dec. 28, 2017

(65) Prior Publication Data

US 2019/0120260 A1 Apr. 25, 2019

(30) Foreign Application Priority Data

Jun. 24, 2016 (DE) ..... 10 2016 007 754

(51) Int. Cl.
*F15B 13/02* (2006.01)
*F15B 13/04* (2006.01)
*F15B 13/00* (2006.01)

(52) U.S. Cl.
CPC ..... *F15B 13/026* (2013.01); *F15B 13/0402* (2013.01); *F15B 13/0417* (2013.01); *F15B 2013/008* (2013.01)

(58) Field of Classification Search
None
See application file for complete search history.

(56) References Cited

U.S. PATENT DOCUMENTS

2016/0201695 A1 7/2016 Biwersi

FOREIGN PATENT DOCUMENTS

DE 10 2013 014 671 3/2015
DE 10 2014 003 086 9/2015
WO WO-2015032492 A2 * 3/2015 ..... F15B 13/0417

OTHER PUBLICATIONS

Translation—WO 2015/032492 A2, Espacenet 2015 (Year: 2015).*
International Search Report (ISR) dated Oct. 11, 2017 in International (PCT) Application No. PCT/EP2017/000700.

* cited by examiner

*Primary Examiner* — Daphne M Barry
(74) *Attorney, Agent, or Firm* — Wenderoth, Lind & Ponack, L.L.P.

(57) ABSTRACT

A valve apparatus for influencing a flow of medium between a supply port (38) and a pressure port (40) has a valve device (10). In one closed position, the valve device blocks the connection between the supply port (38) and the pressure port (40). The valve device opens this connection in one opened position, in which the pressure port (40) is connected to at least one of two medium chambers (62, 80) by a respective fluid channel (64, 82). One fluid chamber (64) comprises a fluid duct (68) in the valve slider (22). The other fluid channel (82) has a further fluid duct (84) that is separate from the fluid duct (68). In one of the opened positions of the valve slider (22), the further fluid duct (84) opens at one end (92) into the medium chamber (80). In every displacement position of the valve slider (22), the further fluid duct (84) is permanently connected at the other end (94) to the pressure port (40).

12 Claims, 4 Drawing Sheets

VALVE APPARATUS FOR INFLUENCING A FLOW OF MEDIUM

FIELD OF THE INVENTION

The invention relates to a valve device for influencing a media flow between a supply port to which a pressure supply source can be connected. A pressure port can be connected to a hydraulic consumer. The valve device has a valve spool, which is guided in axial travel directions within a valve housing. The opposite end faces of the valve housing at least partially delimit two media chambers within the valve housing. The valve device blocks the connection between the supply and the pressure port in at least one closed position which opens that connection in at least one of its open positions, in which the pressure port is connected to at least one of two media chambers via a relevant fluid guide. One fluid guide is formed of a valve spool located in the fluid duct, one end of which opens into a media chamber and the other end of which opens into a fluid chamber in the valve housing. The fluid chamber is separated from the pressure port in the at least one closed position of the valve spool and is disposed between the supply port and pressure port.

BACKGROUND OF THE INVENTION

The solution according to FIG. 3 et seqq. in conjunction with the associated pages of description of DE 10 2014 003 086 A1 discloses a generic valve device. The known valve device also serves to influence a media flow between a supply port, to which a pressure supply source can be connected, and a pressure port, to which a hydraulic consumer can be connected. The valve device has a valve spool, which is guided in a longitudinally movable manner in a valve housing between end positions. A control device is used to limit the pressure regulated by the valve spool at the pressure port, from a predetermined displacement of the valve spool in the direction of one of its end positions, to prevent any overloads of the connected hydraulic pressure consumer. Advantageously, the fluid pressure at the pressure port has a constant pressure difference to the supply port until a permissible maximum pressure is reached.

In a preferred embodiment of the known valve device, the valve housing opens into a control line, which is preferably part of an LS signal line or signal chain. To actuate this control line, the control device has a single fluid duct within the valve spool serving as a control duct. A control side of the valve spool opens into a media chamber within the valve housing. The fluid duct connects this media chamber to a further media chamber, to which the control line and the LS signal line are connected. Within the valve housing in a fluid conveying manner from a predetermined displacement position of the valve spool, that position preferably corresponds to a stop or end position.

In the known solution, the only control or fluid duct is implemented by a system of longitudinal and transverse bores in the valve spool. The dimensioning of the bores has to be as accurate as possible to perform the actuation, resulting in high production cost. It has also been shown in practice that, due to the relatively narrowly dimensioned free duct cross-sections of the control duct mentioned, problems can occur in the immediate transmission of the hydraulic pressure present at the pressure port to the actual regulating side of the valve. This transmission problem results in pressure losses within the fluid guide and consequently to instabilities in the fluid control, which is detrimental to the desired constant pressure reduction on the pressure supply side of the valve. To increase the volume flow using a pressure divider circuit p' downstream of LS, the pressure p' cannot be tapped correctly due to the position of the bore in front of the non-return edge, but is increased by the switching edge as a function of the volume flow Q and the size of the opening.

SUMMARY OF THE INVENTION

Based on this prior art, the invention therefore addresses the problem of further improving this known solution in that the operating behavior in regard to regulation is improved in a cost-effective implementation, while maintaining the advantages of the known solution, namely to achieve a limitation of the valve spool regulated pressure at the pressure or service port of the valve.

A valve according to this invention solves this problem.

According to the invention, its other fluid guide has at least one further fluid duct, which is separated from its first fluid duct and. One end of the first duct opens in at least one of the open positions of the valve spool into the other media chamber. The other end of the first duct in each travel position of the valve spool is connected permanently to the pressure port. The known one-duct solution described above is replaced by a two-duct solution having shortened fluid paths per duct, thereby preventing high pressure losses at the actuated regulating side of the valve, which losses might result in instabilities in fluid control. The further fluid duct being permanently connected to the pressure port of the valve to be regulated. The control processes then take place immediately and without pressure losses due to the otherwise additionally necessary duct guides also contributing to this purpose. The desired regulating processes using the valve device also lead to an overall improved energy balance. The instabilities due to excessive pressure losses mentioned above are prevented with certainty in this way. In spite of the two-duct design, the overall manufacturing costs are reduced, as due to the simpler duct design. To that extent, also due to easier-to-control, regulation and actuation geometries, the manufacturing cost is reduced accordingly.

In a preferred embodiment of the valve device according to the invention, the further fluid duct is arranged in parallel to the axial travel directions of the valve spool, such that when passing an assignable regulating edge transversely to that regulating by the valve spool, the fluid guide of the further fluid duct is deflected from this parallel direction, preferably by 90°. In this way, the two-duct solution having the further fluid duct, which is permanently connected to the pressure port in every travel position of the displacement piston, can be used to achieve an improved regulation quality or control quality compared to the known single-duct solution, in which the fluid guide of the duct emerges perpendicular in planes, parallel to the addressed regulating edge, during the control process.

In a further preferred embodiment of the valve device according to the invention, at least one control duct adjoins one end of the relevant further fluid duct, which points in the direction of the other media chamber, which has a changed, in particular reduced, duct cross-section with respect to the further fluid duct. Preferably, provision is made that the duct cross-section tapers at least in the area of the assignable regulating edge while forming an aperture with the regulating edge, starting from the relevant further fluid duct, in the direction of the relevant control duct. In this way, the relevant further fluid duct in functional connection with the relevant further control duct achieves a type of pressure divider circuit in the regulation position of the valve, which can be used to noticeably increase the required control pressure on the pressure delivery side of the valve. This structure is without parallel in the prior art.

In this case, particularly preferably provision is made that the cross-section of the relevant control duct tapers conically in the direction of a free end face of the valve spool, which end face at least partially limits the other media chamber. The end facing the relevant assignable fluid duct of it opens into the fluid duct forming a ledge-shaped fluid guiding stage. In the pertinent arrangement, the control duct adjoining the relevant fluid duct provides for a fluid flow path, which provides for the required initial regulation processes at the valve spool in a largely continuous manner without obstruction, upon a small alteration of the fluid direction with respect to the parallel alignment at the regulating edge transversely to the same.

To maintain a particularly high regulation quality, it has proven to be advantageous to design the valve such that in a fictitious development of a control edge of the valve spool in the area of at least one regulating edge in the valve housing in a plane, the total length of the control edge is greater than the sum of the individual developments, relative to the same plane, of the free openings of one of the valve ducts located in the fluid passage in the area of its other end, which opens into the fluid chamber in the valve housing.

A particularly high production quality can be achieved at low manufacturing costs if the relevant further fluid duct is formed from a radial wall spacing between the valve spool and the valve housing. A radial wall spacing between the valve housing and valve spool is formed by a uniform diameter reduction in the valve spool, based on the diameter of the free end face of the valve spool, in the direction of the other media chamber. The possibly existing control duct opening in a fluid conveying manner into the fluid ring duct formed in that way is particularly preferred for the purpose of a simplified production. If the further fluid duct does not extend over the entire diameter in the outer wall of the valve spool, the selection of this free diameter can be used to fine-tune the regulation process in the fluid guide.

A defined regulating edge geometry can be achieved, if provision is preferably made in the valve device according to the invention such that the control edge located in the valve housing is delimited by a groove-shaped recess pointing away from the valve spool protruding in its direction.

In the end position of the valve spool, in particular at a designated stop position in the direction of the other media chamber, the relevant further fluid duct has passed over the regulating edge forming a 90° deflection for the fluid guide for the regulation process. The possibly then exists that control duct opens unilaterally into the relevant further fluid duct at this level of the control edge.

Preferably, the valve device is designed as a pressure maintenance-type component.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
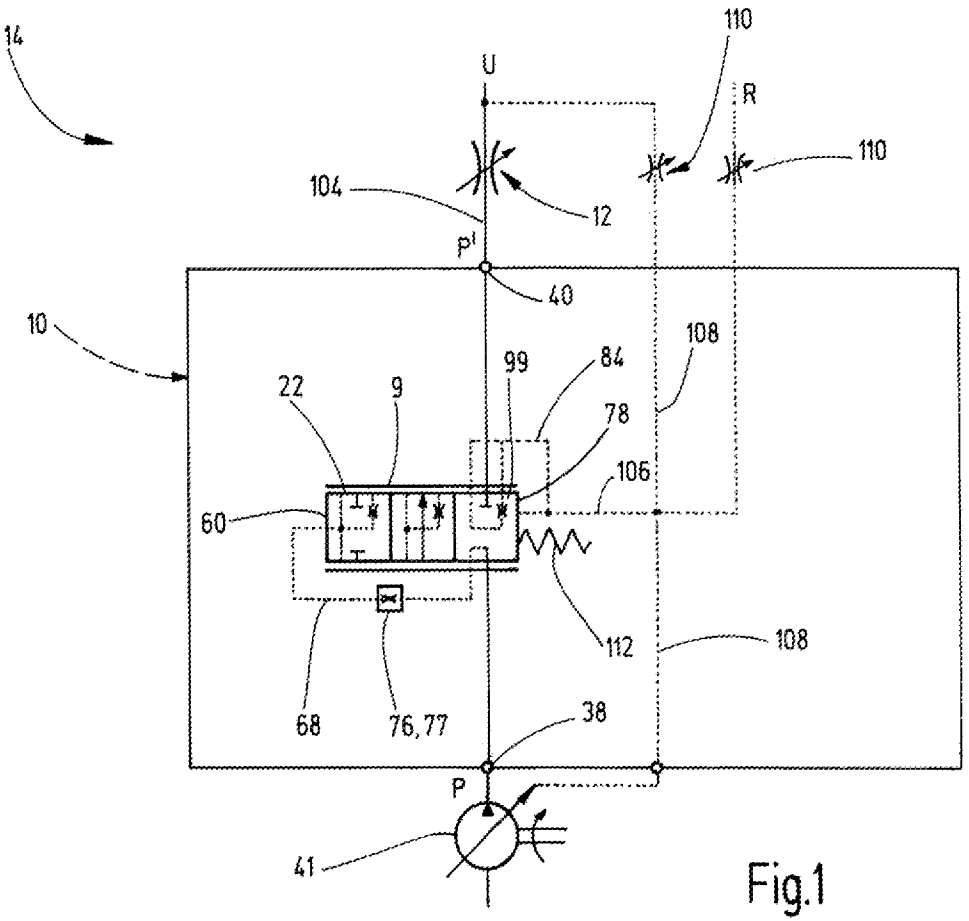
FIG. 1 is a hydraulic schematic diagram of a volumetric flow regulator having a valve device according to a first exemplary embodiment of the invention.

FIG. 1 shows in the form of a hydraulic symbol or schematic diagram of a pressure maintenance component 9 in conjunction with a metering aperture 12, which in the overall function form a volume flow regulator 14 having the valve device according to the invention having the valve or valve device 10. The essential components of valve 10 are combined in a frame-like block representation According to the longitudinal sectional views of FIGS. 2 and 3, a valve housing 18 has a valve bore 20, in which a longitudinally movable guided valve spool 22 is arranged. The valve bore 20 is closed at both ends 24, 26 by cap screws 28, 30, which each engage in an assignable female thread 32 of the valve bore 20. Annular sealing elements 34 are provided between the cap screws 28, 30 and the valve housing 18.

The valve spool 22 is provided for controlling a fluid-conveying connection 36 between at least two fluid connection points 38, 40 mounted in the valve housing 18, a supply port 38 and a pressure port 40. A pressure supply source P (FIG. 1) in the form of a hydraulic pump 41 is connected to the supply port 38. A hydraulic load U (FIG. 1), for example in the form of a hydraulic power cylinder (not shown), can be connected to the pressure port 40 via the connection point P' of the valve device 10. The valve spool 22 has a total of two outwardly projecting control parts 42, 44. The first control part 42 has at least one pocket-shaped recess 46 in the direction of the second control part 42. The second control part 44 is arranged at a distance from the first control part 42 by a first fluid chamber 48 as part of the possible fluid-conveying connection 36. In principle, the solution according to the invention can be implemented using only one control part, for example, the control part 42. However, using only one control part results in disadvantages in the overall control behavior of the piston valve spool 22. In the unactuated state of the valve spool 22, i.e. at zero stroke, in which the valve spool 22 is in the left end position in the image plane (FIG. 2), the second control part 44 is in contact with an inner housing wall 52 of the valve housing 18 by a cylindrical guide part 50. A conical transition part 54 at the control part 44 forms a flow guide for the fluid and causes a ramp-shaped deflection of the fluid flow from the first fluid chamber 48 in the direction of the pressure port 40. The transition part 54 also contributes to the flow force compensation at the valve spool 22.

The valve spool 22 is guided through the inner wall 52 of the housing 18 by a further guide part 56 in the area of the pressure port 40 in the valve housing 18. A rod part 57 is arranged between the first control part 42 and the second control part 44, keeping them at a distance. A second fluid guide 58 between the second control part 44 and the further guide part 56 improves the fluid circulation of the valve spool 22 in the area of the second control part 44, thereby reducing the pressure losses inside the pressure maintenance component 9. Furthermore, the sealing behavior of the second control part 44 with respect to the inner housing wall 52 is improved by the second fluid chamber 58, as the sealing gap between the valve spool 22 and the inner housing wall 52 can be reduced by the introduction of the second fluid chamber 58 into the valve spool 22. The two fluid chambers 48, 58, which form axial distances between the first control part 42 and the second control part 44 or between the second control part 44 and the further guide part 56, are formed by groove-shaped diameter reductions 59 in the valve spool 22. Such diameter reductions 59 are in technical terms also referred to as cut-ins in the valve spool 22.

The valve spool 22 adjoins a first media chamber 62 of variable volume, which media chamber is connected to the first fluid chamber 48 in a fluid conveying manner or in fluid communication via a first fluid guide 64 on its one end face 60, to the left in the image plane. The first fluid guide 64 is formed by a fluid duct 68 located in the center of the valve spool 22, with one longitudinal end 70 opening into the one or first media chamber 62 and other transverse end 72 opening into the first fluid chamber 48 between the two control parts 42, 44 of the valve spool 22 in the valve housing 18 via an opening 74. The edges of the first fluid chamber 48 are bordered by the two control parts 42, 44 of the valve spool 22 and the valve housing 18.

The pressure between the supply port 38 and the pressure port 40 is regulated by the valve spool 22 if the valve is open, and is transmitted into the first media chamber 62 via the one or first fluid duct 68. The fluid pressure existing in the one media chamber 62 then pressurizes the valve spool 22 further in the direction of one of its open positions for the purpose of bringing about a fluid connection with an enlarged passage between the pressure supply port 38 and the pressure port 40. The first fluid duct 68 in the valve spool 22 has a restriction 76 in the area of its deflection from the longitudinal to the transverse duct guide. A further restriction 77 is formed by a graduated expansion of the diameter of the first fluid duct 68 at the end, starting from the other end 72 of the fluid duct 68 in the direction of the one end 70 of the fluid duct 68. These restrictions 76, 77 transmit pressure fluctuations at the supply port 38 in a delayed and attenuated manner to the one media chamber 62 if the valve spool 22 is in one of its open, fluid-passing positions.

Figure 2:
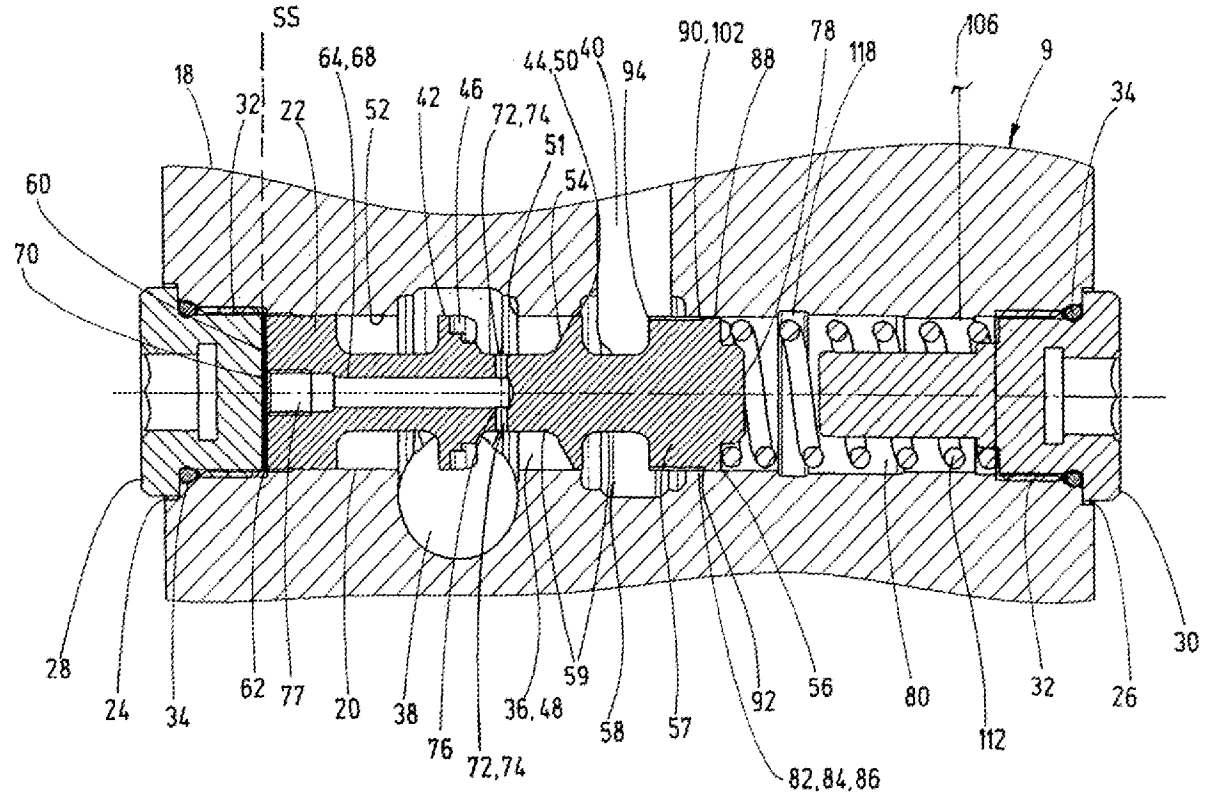
FIG. 2 is a side view in section of the valve device of FIG. 1, having a valve spool in the left stop position in the direction of the one media chamber.
Figure 3:
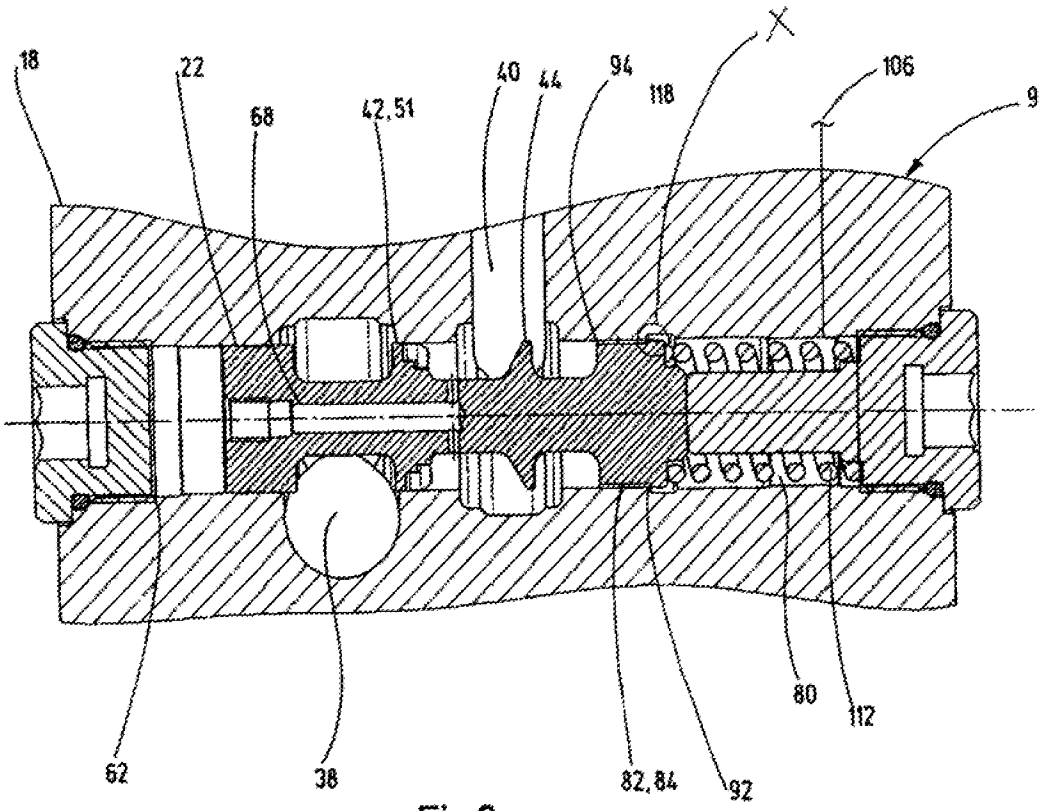
FIG. 3 is a side view in section of the valve device of FIG. 1 having a valve spool in the right stop position in the direction of the other media chamber.

At its other end face 78, the valve spool 22 adjoins another or second media chamber 80 of variable volume. Viewed in the direction of FIGS. 2 and 3, for a predetermined opening displacement of the valve spool 22 towards the right and thus in the direction of the other media chamber 80, media chamber 80 is connected to the pressure port 40 in a fluid-conveying manner via another or second fluid guide 82, such that the first media chamber 62 can be connected to the other media chamber 80 via the first fluid duct 68 and the second fluid duct 84. FIG. 3 shows the pertinent fluid-conveying or fluid communication connection between the pressure port 40 and the media chamber 80 Furthermore, one free end of the end face 78 of the valve spool 22 rests against a compression spring 112. The other free end of spring 112 is in contact with the end screw 30, thereby passing through the second media chamber 80. Further, the compression spring 112 having a predefined prestress is in abutment with the valve spool 22 even in the zero position of the valve spool 22 (FIG. 2).

Figure 5:
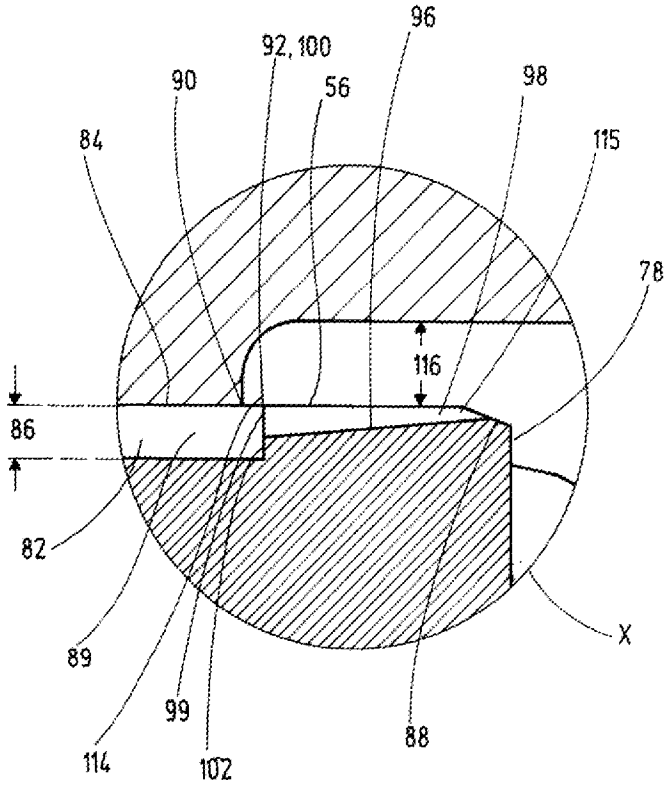
FIG. 5 is an enlarged partial side view of the area bordered by the circle X in FIG. 3 according to a second exemplary embodiment of the invention, compared to the embodiment according to FIG. 4.
Figure 4:
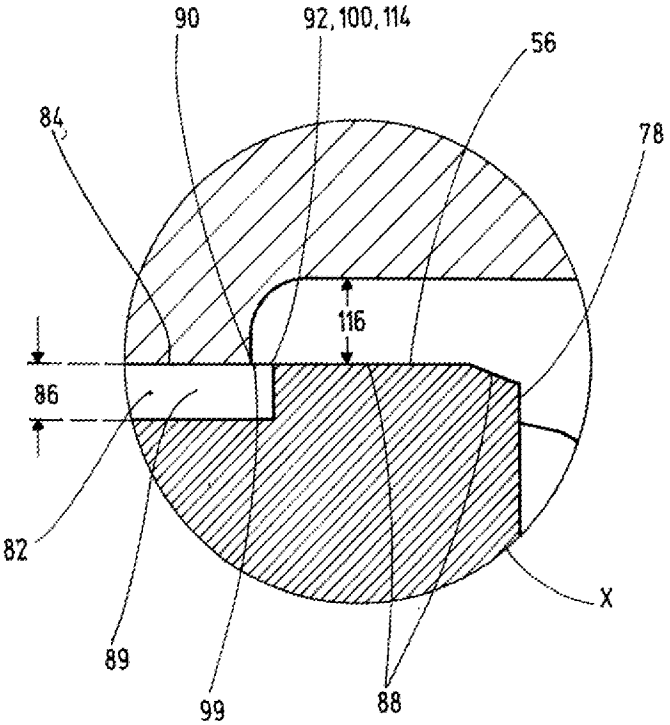
FIG. 4 is an enlarged partial side view in section of an area surrounded by a circle X in FIG. 3.

As further shown in FIGS. 4 and 5, the second fluid guide 82 is formed by the further fluid duct 84, which extends in the form of a diameter reduction 86 of the valve spool 22, in relation to a diameter 88 of the free other end face 78 of the valve spool 22 and limited by the further guide part 56 of the valve spool 22. Fluid duct 84 ends parallel to the axial travel directions of the valve spool 22. In this way, the further fluid duct 84 may be formed as at least one groove-shaped diameter reduction 86 in the valve spool 22 or preferably from a radial wall spacing 89 between valve spool 22 and valve housing 18 along the entire outer circumference of the valve spool 22 in this area. The radial wall spacing 89 between the valve housing 18 and valve spool 22 is formed by the uniform diameter reduction 86, based on the relevant diameter 88 of the free other end face 78 of the valve spool 22, in the valve spool 22 in the direction of the pressure port 40 as this area.

The second fluid duct 84 is spatially separated from the one, first fluid duct 68 in terms of a two-duct solution and as regards the fluid management concept by two spatially separate fluid guides 82, 64. The second fluid duct 84 is permanently connected to the pressure port 40 in a fluid conveying manner or in fluid communication by the one free end 94 of the second fluid duct 84 that faces away from the second media chamber 80 in every travel position of the valve spool 22 in a manner essential to the invention. In the direction of the second media chamber 80, the diameter reduction 86 of the valve spool 22, spaced from the other end face 78 of the valve spool 22, formed in or on the further guide part 56 terminates at one end 92. In the area of an assignable regulating edge 90 in the valve housing 18, the valve spool 22 abruptly transitions into the full diameter 88 of the end portion of the further guide part 56 of the valve spool 22 adjoining the other end face 78 of the valve spool 22. A control edge 114 is then formed at the location of the offset in the valve spool 22. The regulating edge 90, fixedly arranged in this respect, then forms the cross-section of the aperture or control between the pressure or consumer port 40 and the media chamber 80 to be regulated by the movable control edge 114, which is symbolically represented in FIG. 1 by the representation of a throttle or aperture 99. The total length of the development of the control edge 114 in a fictitious plane extending horizontally (not shown) is greater than the sum of the individual developments, in relation to that same horizontal plane, of the free openings 74 of the first fluid duct 68 located in the valve spool 22 in the area of its other end 72, which opens into the first fluid chamber 48 in the valve housing 18 via these openings 74.

As shown in FIG. 5 in a modified embodiment of the solution according to FIG. 4, the other end 92 of the further fluid duct 84, shown in FIG. 4 and described above, facing the second media chamber 80 adjoins at least one control duct 96. The duct cross-section of control duct 96 is reduced in comparison to the further fluid duct 84. The relevant control duct 96, viewed in cross-section, tapers in the direction of the other free end face 78 of the valve spool 22. At its end 100 facing the further fluid duct 84, control duct 96 opens into the further or second fluid duct 84 to form a shoulder-shaped fluid guide stage 102. Viewed in the direction of FIG. 5, the conically reduced cross-section of the right end of the control duct 86 forms a further control edge 115 at the free end of the valve spool 22. Control edge 115 forms a further throttle or aperture device for the fluid with the regulating edge 90 of the housing 18, as soon as the further control edge 115 passes over the free cross-section at the stationary regulating edge 90, which happens if, during opening valve positions, the valve spool 22 travels from its zero position shown in FIG. 2 to its regulating positions in the direction of the end or stop position according to FIG. 3 towards the right.

The relevant control duct 96 opens into the fluid ring duct formed by the radial wall spacing in a permanently fluid conveying manner if the diameter reduction 86 is formed as a radial wall spacing 5 between valve spool 22 and valve housing 18. Instead of a single or multiple control ducts 96, only one control duct space having a conical cross-section in the valve spool 22 can be formed by a circumferential diameter reduction.

As shown in FIG. 1, the hydraulic consumer U is connected to the connection port P' of the valve device 10 at the pressure port 40 via a fluid-conveying line 104. A regulating device, in particular formed in the manner of the metering aperture 12, is provided in the fluid-conveying line 104. For "mapping" the fluid pressure between the consumer U and the metering aperture 12 to the other end face 78 of the valve spool 22, a corresponding control line 106 in the form of an LS signal line 108 is provided. Control line 106 is connected to the valve housing 18 and opens into the other media chamber 80. The LS signal line 108 is in turn connected to the hydraulic pump 41 in the form of a variable displacement pump 16. The pivoting angle of the hydraulic pump 41, which also specifies the pressure at the supply port 38, is regulated as a function of the system pressure in the LS signal line 108. The hydraulic load message system formed in that way can be used to quickly adapt the pressure at the supply terminal 38 provided by the hydraulic pump 41 to the requirements of the hydraulic consumer U. Furthermore, provision is made that fluid can flow into a tank connection or other return port R at substantially ambient pressure via the LS signal line 108, from the other media chamber 80 via an adjustable throttle or aperture 110. The LS signal line 108 also has a comparable throttle or aperture 110.

A fluid pressure existing in the other media chamber 80 pressurizes the other end face 78 of the valve spool 22 to the left in the direction of the closed position SS, in which the valve spool 22 completely disconnects the pressure port 40 from the supply port 38 at zero stroke. In addition, the other end face 78 of the valve spool 22 is pressurized by the energy store in the form of the compression spring 112.

The pressure regulated by the valve spool 22 between the supply port 38 and the pressure port 40 can be limited by the one fluid duct 68. The further fluid duct 84 and optionally by the control duct 96 adjacent to the further fluid duct 84, starting from a predetermined displacement of the valve spool 22 in the direction of the other media chamber 80, discharges excess fluid via the control line 106 into the LS signal line 108 from the other media chamber 80 based on the interposition of the throttle or aperture 99.

Below, the operation of the valve device, as far as necessary for understanding the invention, is explained in more detail:

In the unactuated state of the valve spool 22, i.e. at zero stroke (FIG. 2), the valve spool 22 is positioned in stop position in the direction of the one media chamber 62. The second control part 44 is in contact with the inner housing wall 52 of the valve housing 18 in the area between supply port 38 and pressure port 40 by the cylindrical guide part 50, such that the valve spool 22 is arranged in one of its closed positions SS, in which it blocks the fluid-conveying connection 36 between the supply port 38 and the pressure port 40. In this position SS, the second fluid duct 84 and optionally the control duct 96 is covered by the inner housing wall 52 in a sealing manner, and the end portion of the further guide part 56 is in sliding contact with the assignable inner housing wall 52 facing other media chamber 80.

A fluid pressure present at the supply port 38 is transmitted into the one media chamber 62 via the first fluid duct 68. There it acts on the adjacent end face 60 of the valve spool 22. On the opposite other end face 78, the valve spool 22 is pressurized by the load pressure via the LS signal line 108 and the control line 106 and the compression spring 112. If the fluid pressure at the supply port 38 exceeds the counter pressure by the load pressure and the compression spring 112, the valve spool 22 moves from the closed position SS in the direction of the other media chamber 80, such that the valve attains one of its open positions. As a result of this increasing displacement of the valve spool 22, the second control part 44 is brought out of engagement with the inner housing wall 52 such that the fluid-conveying connection 36 between the supply port 38 and the pressure port 40 is also progressively opened.

From a predetermined displacement of the valve spool 22, the further fluid-conveying connection 48 is interrupted by closing the first control part 42 at a further closing edge 51 of the housing 18. Simultaneously, the fluid-conveying connection between the media chambers 62, 80 is established because, if no control duct 96 is provided, the other end 94 of the further fluid duct 84 or, if a control duct 96 is provided, the other media chamber 80 facing the end of this control duct 96, has passed over the regulating edge 90 in the valve housing 18. Regulating edge 90 is present in the inner housing wall 52 of the valve housing 18, thereby forming a corresponding deflection for the other fluid guide 82, which limits a groove-shaped recess 116 facing away from the valve spool 22 but protruding in its direction. This further fluid-conveying connection 118 between the media chambers 62, 80 results in pressure equalization between these media chambers 62, 80.

Under the action of the compression spring 112, the valve spool 22 is again moved to the left in the direction of its closed position SS, as long as the pressure equalization in the chambers 62, 80 is present. Because the fluid from the other media chamber 80 can only flow to a very limited extent, i.e. throttled, in the direction of the LS signal line 108 and optionally in the direction of the return port R or tank port via the control line 106, the effect is amplified. If the valve spool 22 has moved sufficiently far in the direction of the closed position SS, the inner housing wall 52 of the valve housing 18 overlaps the further fluid duct 84, and possibly the control duct 96, in an at least partially sealing manner. Subsequently a contact of the end area of the further guide part 56 facing the other media chamber 80 occurs, whereby the fluid-conveying connection between the media chambers 62, 80 is, upon increasing displacement of the valve spool 22 to the left, is initially throttled and subsequently completely disconnected. Due to this mode of operation described above, an equilibrium position normally sets in to limit the pressure at the pressure port 40 advantageously to a predefinable maximum value.

Consequently, the hydraulic consumer U can no longer be overloaded. Advantageously, the fluid pressure at the pressure port 40 has a constant pressure difference to the supply port 38 until the permissible maximum pressure is reached. The aperture or regulating cross-sections 90, 114 and, possibly, 90, 115 ensure that the pressure P' upstream of the metering aperture 12 can be set in a defined manner, regardless of the current fluid demand at the consumer U.

As a result, a valve device is shown, which prevents the pressure fluctuations at the supply port 38 from passing through the pressure maintenance component 9 in an undamped manner, and thus, effectively prevents any overload of the hydraulic load U. Also advantageously, the valve device improves the control performance, while simultaneously providing for a cost-effective implementation.

While various embodiments have been chosen to illustrate the invention, it will be understood by those skilled in the art that various changes and modifications can be made therein without departing from the scope of the invention as defined in the claims.

The invention claimed is:

1. A valve device for influencing media flow from a pressure supply source to a hydraulic consumer, the valve device comprising:

a valve housing having first and second media chambers therein;

a supply port being connectable to the pressure supply source and being in said valve housing;

a pressure port being connectable to a hydraulic consumer and being in said valve housing;

a valve spool being guides for axial movement within said valve housing and having first and second end faces on opposite ends of said valve spool, said first and second end faces delimiting partially said first and second media chambers, respectively, said valve spool being movable between a closed position blocking fluid communication between said supply port and said pressure port and open positions releasing fluid communication between said supply port and said pressure port;

a first fluid guide having a first fluid duct in said valve spool with one end of said first fluid duct opening into said first media chamber and another end of said first fluid duct opening into a fluid chamber in said valve housing being separated in fluid communication from said pressure port in the closed position of said valve spool and being between said supply port and said pressure port; and a second fluid guide having a second fluid duct being separate from said first fluid duct, said second fluid duct having one end opening into said second media chamber in at least one of the open positions of said valve spool and having another end permanently connected in fluid communication to said pressure port in every travel position of said valve spool in said valve housing.

2. A valve device according to claim 1 wherein said second fluid duct extends parallel to the axial movement of said valve spool and subjects fluid conveyed through said second fluid duct to deflect from being parallel to the axial movement of said valve spool when a regulating edge in said valve housing passes transversely over said second fluid guide.

3. A valve device according to claim 1 wherein said second fluid duct extends in a parallel direction to the axial movement of said valve spool and deflects from the parallel direction when passing a regulating edge in said valve housing transversely to said second fluid guide.

4. A valve device according to claim 3 wherein said second fluid duct has a control duct extending from said second fluid duct with a cross section tapering in an area of said regulating edge and forms an aperture with said regulating edge starting from said second fluid duct in a direction of said control duct.

5. A valve device according to claim 4 wherein said cross section of said control duct tapers conically in the direction of said second end face of said valve spool, the one end of said second fluid duct forming a ledge-shaped fluid guiding stage adjacent said control duct.

6. A valve device according to claim 3 wherein said valve spool comprises a control edge in an area of said regulating edge in said valve housing in a plane, a total length of said control edge of said valve spool being greater than a sum of free openings of said first fluid duct in said plane.

7. A valve device according to claim 1 wherein said second fluid duct is formed from a radial wall spacing between said valve spool and said valve housing.

8. A valve device according to claim 7 wherein said radial wall spacing between said valve housing and said valve spool comprises a uniform diameter reduction in said valve spool relative to said second end face.

9. A valve device according to claim 8 wherein a control duct extends from said second fluid duct and opens in fluid communication into a fluid ring duct.

10. A valve device according to claim 3 wherein said regulating edge in said valve housing encompasses said valve spool in a regulating position of said valve spool in a regulating position of said valve spool and limits a groove-shaped recess opening away from said valve spool in the direction of the axial movement of the valve spool.

11. A valve device according to claim 1 wherein in an end position of said valve spool in a direction of said second media chamber, said second fluid duct has traveled over a regulating edge in said valve housing forming a 90 degree deflection for said second fluid guide.

12. A valve device according to claim 11 wherein a control duct extends from an end of said second fluid duct and opens on said second end face of said valve spool.

* * * * *